US009010726B2

(12) United States Patent
Biddick

(10) Patent No.: US 9,010,726 B2
(45) Date of Patent: Apr. 21, 2015

(54) REDUCED LENGTH ACTUATION SYSTEM

(75) Inventor: David James Biddick, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 417 days.

(21) Appl. No.: 13/290,316

(22) Filed: Nov. 7, 2011

(65) Prior Publication Data

US 2013/0112901 A1 May 9, 2013

(51) Int. Cl.
*F16K 1/16* (2006.01)
*E21B 34/10* (2006.01)
*E21B 34/00* (2006.01)

(52) U.S. Cl.
CPC ..... *E21B 34/10* (2013.01); *E21B 2034/005* (2013.01)

(58) Field of Classification Search
CPC ..... F16F 1/06; F16F 1/368; F16F 1/373; F16F 1/3732; F16F 2234/08; F16K 31/1221
USPC ..... 166/332.8; 267/180, 125; 251/303, 337
See application file for complete search history.

(56) References Cited

U.S. PATENT DOCUMENTS

| | | | | |
|---|---|---|---|---|
| 3,002,526 | A | 10/1961 | Terral | |
| 3,278,176 | A * | 10/1966 | Abolins | 267/180 |
| 5,029,646 | A | 7/1991 | Blizzard, Jr. | |
| 5,368,108 | A | 11/1994 | Aldred et al. | |
| 5,411,096 | A * | 5/1995 | Akkerman | 166/321 |
| 5,564,675 | A * | 10/1996 | Hill et al. | 251/62 |
| 6,053,251 | A * | 4/2000 | Deaton | 166/321 |
| 6,315,047 | B1 | 11/2001 | Deaton et al. | |
| 6,530,432 | B2 * | 3/2003 | Gipson | 166/384 |
| 2008/0066767 | A1 * | 3/2008 | Paraschac et al. | 128/848 |
| 2009/0242206 | A1 | 10/2009 | Goughnour et al. | |
| 2011/0100471 | A1 * | 5/2011 | Schroeder et al. | 137/2 |

* cited by examiner

*Primary Examiner* — Marina Tietjen

(57) ABSTRACT

A technique provides a component actuation system in a space efficient form. A movable actuator member may be positioned within a corresponding housing in a manner which forms an annulus between the movable actuator member and the surrounding wall of the housing. A spring is located in the annulus and is designed such that the spring extends part way along a circumference of the actuator member to create an open annular region between circumferential ends of the spring. The open annular region provides space for a system related component without requiring additional longitudinal or radial space.

10 Claims, 4 Drawing Sheets

REDUCED LENGTH ACTUATION SYSTEM

BACKGROUND

Hydrocarbon fluids, e.g. oil and natural gas, are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing fluids from the reservoir. For example, various types of valves, e.g. subsurface safety valves, may be installed as part of the well completion. In many subsurface safety valves, a flow tube is moved in a longitudinal direction to open a flapper or to allow the flapper to close. Movement of the flow tube in the opening direction is resisted by a spring member that tends to take substantial space and/or increase the overall length of the valve.

SUMMARY

In general, the present disclosure provides an actuation system in a space efficient form. A movable actuator member may be positioned within a corresponding housing in a manner which forms an annulus between the movable actuator member and the surrounding wall of the housing. A spring is located in the annulus and is designed such that the spring extends part way along a circumference of the actuator member to create an open annular region between circumferential ends of the spring. The open annular region provides space for a system related component, such as an actuator piston or control line.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which enable actuation of tools by employing a space efficient actuator system. The space efficient actuator uses a movable actuator member, such as a flow tube in a subsurface safety valve. The movable actuator member is positioned within a corresponding housing so as to form an annulus between the movable actuator member and the surrounding wall of the housing. If the movable actuator member comprises a flow tube in a subsurface valve, the corresponding housing may comprise or be part of the valve housing. A spring member is located in the annulus and may be designed as an arc spring. In other words, the spring member extends part way along a circumference of the actuator member to create an open annular region between circumferential ends of the spring member.

The open annular region provides space for a system related component without, for example, requiring additional longitudinal or radial space. In some applications, the open annular region may contain at least a portion of an actuator piston used to move the flow tube. In other applications, however, the open annular region may be used to contain a variety of other related components, such as a control line or control lines extending at least part way through the tool. In some embodiments, creation of the open annular region enables arrangement of components in parallel instead of in series, thus improving the space efficiency of the overall tool. With a subsurface safety valve, the ability to locate at least a portion of the actuating piston within the open annular region enables shortening of the valve housing and other valve opponents to reduce not only the length of the valve but also the cost of construction. Placement of the actuator piston in the open annular region is also useful for a variety of other rod-piston type devices which are balanced by a mechanical spring. In these other types of devices, the arc spring and the piston actuator can similarly be positioned in parallel to create a shorter, more space efficient tool.

Figure 1:
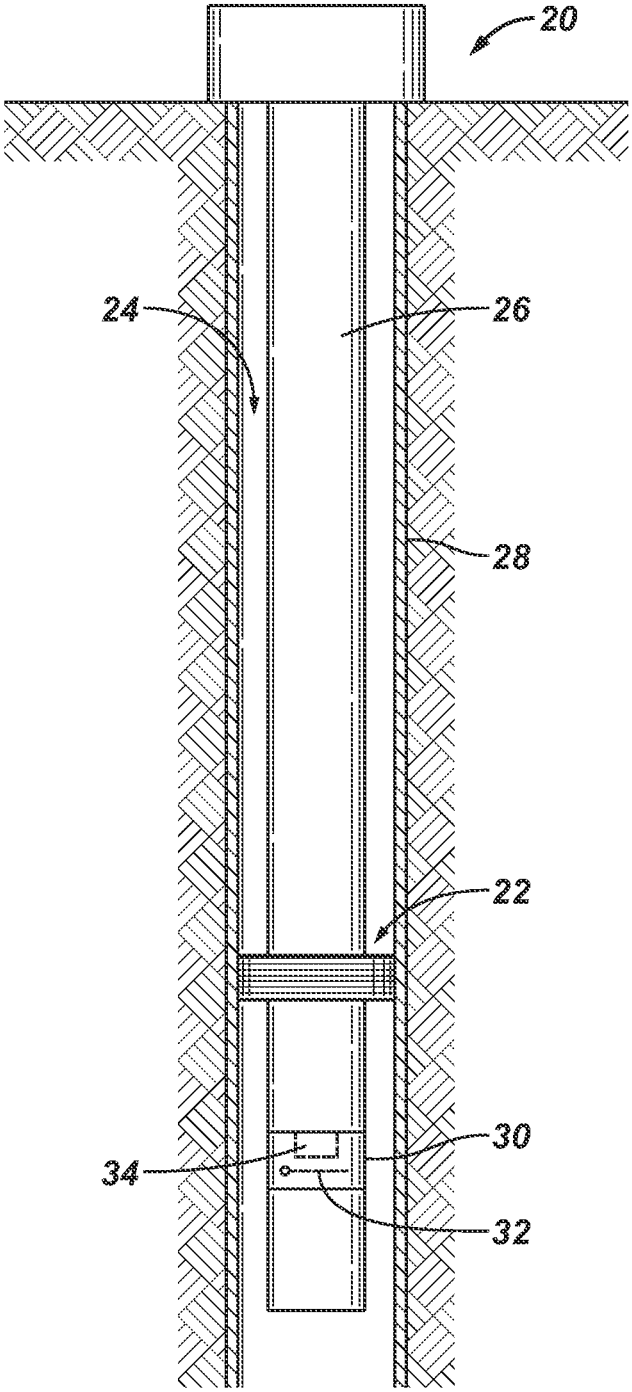
FIG. 1 is a schematic illustration of an example of a well system comprising an actuatable component, according to an embodiment of the disclosure.

Referring generally to FIG. 1, an example of one type of application utilizing an actuatable tool is illustrated. The example is provided to facilitate explanation, and it should be understood that a variety of tools may utilize the actuation systems described herein. The various tools may comprise downhole well tools, e.g. piston actuated valves, or other non-well related tools for use in many types of environments and applications.

In FIG. 1, an embodiment of a well system 20 is illustrated as comprising downhole equipment 22, e.g. a well completion, deployed in a wellbore 24 via a conveyance 26, e.g. production tubing or coiled tubing. Downhole equipment 22 may include a wide variety of components, depending in part on the specific application, geological characteristics, and well type. In the example illustrated, the wellbore 24 is substantially vertical and lined with a casing 28. However, various well completions and other embodiments of downhole equipment 22 may be used in a well system having many types of wellbores, including deviated, e.g. horizontal, single bore, multilateral, single zone, multi-zone, cased, uncased (open bore), or other types of wellbores.

In the example illustrated, downhole equipment 22 comprises an actuatable tool 30, such as a subsurface safety valve which may be actuated between different operational positions, e.g. positions blocking flow or allowing flow along the interior of downhole equipment 22. When tool 30 is in the form of a subsurface safety valve, the valve comprises an actuatable valve element 32 such as a ball or flapper. If the valve element 32 is in the form of a flapper, the flapper may be transitioned between the positions allowing flow and blocking flow by a flow tube selectively actuated by a piston movable along a piston passage in the valve housing, as discussed in greater detail below. It should be noted, however, tool 30 may comprise other types of tools, including a variety of rod-piston type devices which are balanced by a mechanical spring. For example, tool 30 may comprise a hydraulic communication sleeve.

Figure 2:
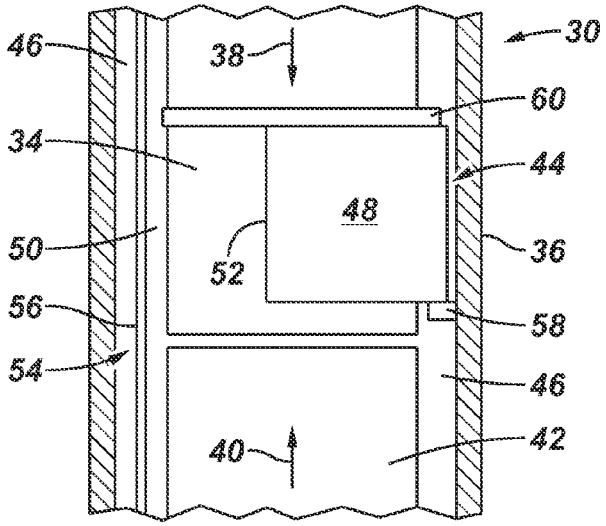
FIG. 2 is an illustration of an example of the actuatable component, according to an embodiment of the disclosure.

Referring generally to FIG. 2, a schematic example of one type of tool 30 is illustrated. This embodiment of tool 30 may be used in downhole applications as, for example, a subsurface safety valve, a hydraulic communication sleeve, or a flow restrictor, such as a hydraulically actuated choke. As illustrated, the tool 30 comprises an annular actuator member 34 surrounded by a corresponding housing 36. If tool 30 comprises a subsurface safety valve, the annular actuator member 34 may be in the form of a flow tube, as discussed in greater detail below with reference to FIG. 3. The annular actuator member 34 may be selectively moved linearly in one of the opposing directions illustrated by arrows 38 and 40.

By way of example, a hydraulic piston or other hydraulic actuation system may be used to move annular actuator member 34 in the direction of arrow 38. Movement in the direction of arrow 38 causes a corresponding movement of a tool member 42, e.g. a valve element, to a different operational position. However, movement of the annular actuator member 34 in the direction of arrow 38 also creates a counter bias in the direction of arrow 40 via a spring member 44. When the hydraulic pressure (or other force acting in the direction of arrow 38) is released, spring member 44 moves the annular actuator member 34 back in the direction of arrow 40.

In this embodiment, the annular actuator member 34 is positioned within housing 36 to create an annulus or annular region 46. The spring member 44 is formed as an arc spring 48 which extends part way along a circumference of the movable, annular actuator member 34 to create an open annular region 50 between circumferential ends 52 of the arc spring 48. The circumferential ends 52 may be parallel with each other or non-parallel depending on the overall design of the tool 30. In some embodiments, the arc spring forms a single spring extending over a partial distance along a circumferential outer surface of the annular actuator member to create the open annular region 50 of a desired size. The open annular region 50 creates space for an additional component or components 54 positioned in parallel with the spring member 44. By way of example, the component 54 may comprise a control line 56 or other suitable component. The open annular region 50 also provides space for at least a portion of an actuator piston when tool 30 is in the form of a subsurface safety valve or other piston actuated device.

In the example illustrated, arc spring 48 is held or captured between corresponding stops 58 and 60. Stop 58 may be coupled to or formed as part of the corresponding housing 36, and stop 60 may be coupled to or formed as part of annular actuator member 34. As annular actuator member 34 is moved in the direction of arrow 38, stop 60 compresses the arc spring 48 against stop 58 to create mechanical stored energy in the arc spring 48. The stored energy creates counter force acting in a direction separating stop 60 from stop 58. Thus, once the force moving annular actuator member 34 in the direction of arrow 38 is sufficiently reduced, the energy stored in arc spring 48 forces movement of annular actuator member 34 in the direction of arrow 40.

Figure 3:
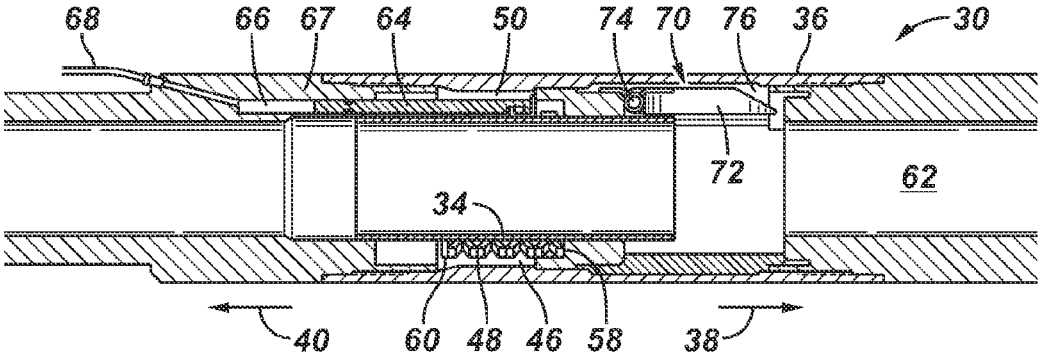
FIG. 3 is an illustration of another example of an actuatable component in the form of a subsurface valve, according to an alternate embodiment of the disclosure.

Referring generally to FIG. 3, an example of tool 30 is illustrated in the form of a subsurface safety valve. The illustrated subsurface safety valve 30 has a main internal flow passage 62 which is disposed generally longitudinally through housing 36 which, in this example, is the subsurface safety valve housing. The internal flow passage 62 accommodates flow along the interior of downhole equipment 22. The subsurface safety valve 30 also comprises annular actuator member 34 in the form of a flow tube slidably received in the corresponding housing 36. A piston 64, e.g. a hydraulic piston, is coupled to the flow tube 34 and moves within a piston passage 66 located in housing 36. For example, the hydraulic piston 64 may be slidably received in a wall 67 of housing 36 between the main flow passage 62 and an exterior surface of housing 36. The hydraulic piston is positioned for slidable movement in response to pressurized fluid delivered to piston passage 66 via a hydraulic line 68. Fluid in piston passage 66 may be selectively pressurized and applied against the hydraulic piston 64 to move the hydraulic piston 64 (and thus the annular actuator member/flow tube 34 to which piston 64 is coupled) in the direction represented by arrow 38. In the specific embodiment illustrated in FIG. 3, hydraulic piston 64 comprises a rod piston engaging flow tube 34. It should be noted that hydraulic piston 64 is an example of an actuator, but other types of actuators, e.g. electric actuators, may be used to move the flow tube 34. For example, piston 64 may comprise an electrically actuated piston. Additionally, a plurality of hydraulic or electric pistons 64 may be employed.

In the example illustrated, tool/subsurface safety valve 30 further comprises arc spring 48 located in the annulus 46 formed between the outer circumferential surface of flow tube 34 and the surrounding housing 36. The arc spring 48 is positioned longitudinally between stops 58 and 60. In this example, the arc spring 48 again extends part way along a circumference of the movable, annular actuator member/flow tube 34 to create the open annular region 50 between circumferential ends 52 of the arc spring 48. Hydraulic piston 64 may be disposed at least partially within open annular region 50 in parallel with arc spring 48. By way of example, the piston 64 may occupy the same axial space as the arc spring 48 not only during the compression portion of the operation of subsurface safety valve 30 but also when arc spring 48 is in the fully relaxed position. The overall length of valve 30 is reduced by the amount of overlap, thus enabling corresponding reductions in length of other valve components, e.g. the valve housing and flow tube. It should be noted that in this particular example arc spring 48 is formed as a modified wave spring but several other forms of the arc spring may be employed.

The subsurface safety valve 30 further comprises a valve component 70 positioned within housing 36 to selectively open or close internal flow passage 62. In the specific example illustrated, valve component 70 comprises a flapper 72 pivotably mounted within the surrounding valve housing 36 at a pivot point 74 for pivotable motion between a closed position blocking flow along internal flow passage 62 and an open position allowing flow along the internal flow passage 62. The valve component 70 is actuated between closed and open positions via linear movement of flow tube 34. In some embodiments, the flow tube 34 may be designed to cover only a portion of the flapper 72 when the flapper 72 is forced to the open position by the flow tube as illustrated in FIG. 3. This approach may be used to further shorten the length of flow tube 34 and the overall length of subsurface safety valve 30.

Flow tube 34 is positioned so as to force the flapper 72 to the open position when moved in the direction illustrated by arrow 38. In transitioning to the open position, flow tube 34 forces the flapper 72 into a radial recess 76 of housing 36 and secures the flapper 72 in this position. Arc spring 48 resists motion in the direction of arrow 38 by exerting a counterforce, as represented by arrow 40, in a direction generally opposite to the direction represented by arrow 38. Thus, when the pressure acting on hydraulic piston 64 is released, arc spring 48 moves flow tube 34 in the direction of arrow 40 until flapper 72 is allowed to pivot to the closed position. In many applications, the closed position is designed so that flapper 72 blocks fluid flow in one direction along internal flow passage 62 while allowing flow in an opposite direction along internal flow passage 62.

Figure 4:
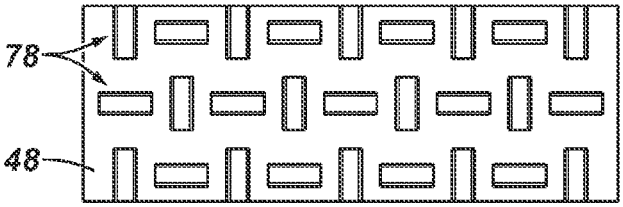
FIG. 4 is an illustration of an example of a spring member, according to an embodiment of the disclosure.
Figure 5:
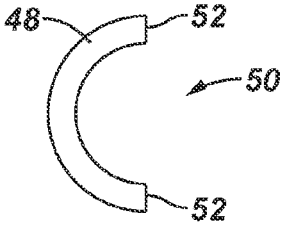
FIG. 5 is an end view of the spring member illustrated in FIG. 4, according to an embodiment of the disclosure.

Referring generally to FIGS. 4-9, several embodiments of arc spring 48 are illustrated. Depending on the design of tool 30 and on the environment in which tool 30 is utilized, the size, shape, structure, and materials selected for arc spring 48 may vary. In each of these designs, the arc spring 48 is limited in dimension angularly to provide open annular region 50 and to enable greater freedom of design. In FIGS. 4 and 5, for example, arc spring 48 is designed to extend along approximately half the circumference of the annular actuator member 34, e.g. flow tube. The design provides a substantially large open annular region 50, however the arc spring 48 may be designed to extend along more or less of the actuator member circumference. In this embodiment, arc spring 48 is a machined arc spring having a machined pattern 78 designed to provide a stable configuration. In some applications, machined pattern 78 provides sufficient stability so that the arc spring 48 may be used without boundary constraints. The specific design of machined pattern 78 can vary substantially depending on the desired spring rate, spring material, and other parameters.

Figure 6:
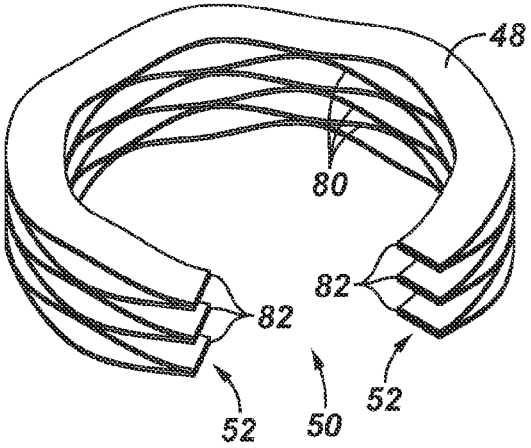
FIG. 6 is an illustration of another example of a spring member, according to an embodiment of the disclosure.
Figure 7:
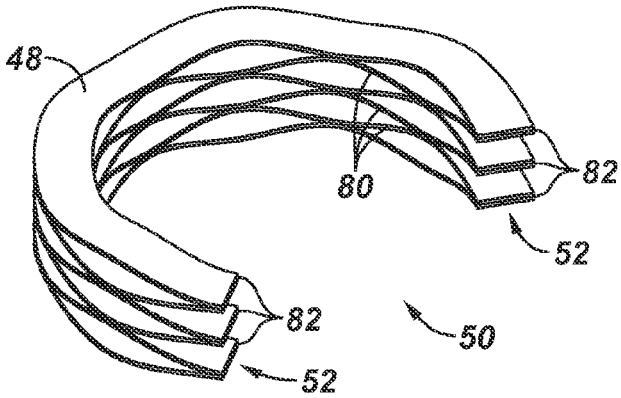
FIG. 7 is an illustration of another example of a spring member, according to an embodiment of the disclosure.
Figure 8:
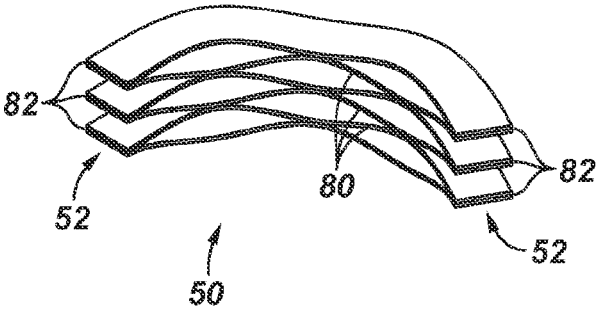
FIG. 8 is an illustration of another example of a spring member, according to an embodiment of the disclosure.

In FIG. 6, another embodiment of arc spring 48 is illustrated in the form of an arc wave spring. The wave spring may comprise a plurality of wave portions 80, such as a wavy metallic strips/sheets, which are stacked together. The circumferential ends of the wave portions 80 are tied together at endpoints 82 which create circumferential ends 52 of the arc spring 48. In the embodiment illustrated in FIG. 6, the arc spring 48 is designed to extend over substantially more than half, e.g. more than 75%, of the circumferential distance along the exterior of annular actuator member 34. Depending on the size of the arc spring 48 and the configuration and materials used in constructing the arc spring, the size of the open annular region 50 can vary. In FIG. 7, for example, the arc spring 48 extends along substantially more than half of the circumference of the annular actuator member 34 but less than the embodiment illustrated in FIG. 6. Consequently, a larger open annular region 50 is provided. In some embodiments, however, the arc spring 48 extends over less than half the circumferential distance along the exterior of annular actuator member 34, as illustrated in FIG. 8.

In some applications, the strips/sheets forming wave portions 80 may use clips or windings to secure the stacked wave portions together. The clips or windings are placed at points of contact between adjacent wave portions 80 while allowing enough radial clearance on the exterior to account for any displacement as the spring is compressed. In another embodiment, the wave spring may comprise waves that are formed as one continuous folding.

Figure 9:
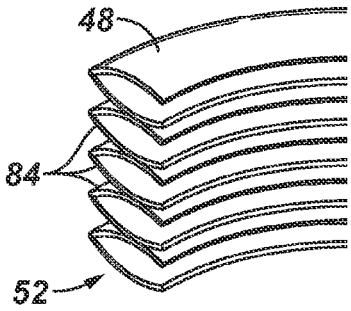
FIG. 9 is an illustration of another example of a spring member, according to an embodiment of the disclosure.

Another embodiment of the arc spring 48 is illustrated in FIG. 9. In this embodiment, the arc spring 48 is formed from a set of Belleville washers 84 which are stacked and truncated at the circumferential ends 52 to again form a spring member with limited angular displacement. Regardless of the specific structure of arc spring 48, the arc spring may be designed to provide open annular regions 50 of suitable sizes to accommodate the desired parallel component, e.g. hydraulic piston 64 or control line 56. The arc spring 48 is designed to extend part way along the circumference of an annular actuator member, such as a flow tube, and to leave an open annular space which enables parallel placement of components with the consequent reduction in size of the tool, e.g. shortening of a subsurface safety valve.

Figure 10:
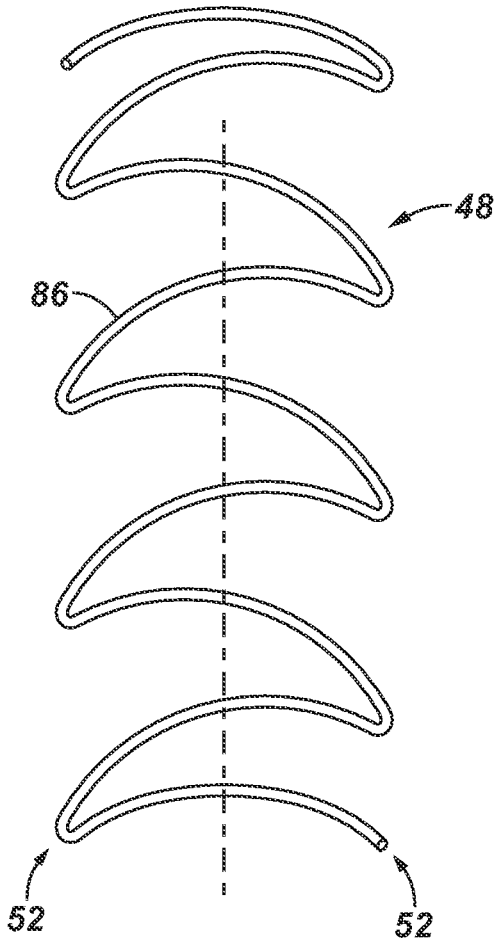
FIG. 10 is an illustration of another example of a spring member, according to an embodiment of the disclosure.
Figure 11:
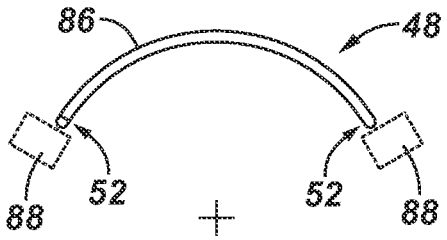
FIG. 11 is an end view of the spring member illustrated in FIG. 10, according to an embodiment of the disclosure.

Referring generally to FIGS. 10 and 11, another embodiment of arc spring 48 is illustrated. In this embodiment, spring 48 is constructed as an arc coil spring 86 having a spring structure which undulates or coils back and forth while extending only a partial circumferential distance, as illustrated best in FIG. 11. In this embodiment and in other embodiments described above, the arc spring 48 may be restrained from movement circumferentially to avoid interference with, for example, control lines or pistons. Restraints 88 may be positioned at the circumferential ends 52 to restrain arc spring 48 circumferentially while allowing axial deflection. By way of example, restraints 88 may comprise ribbing or other structures positioned to an internal flow tube, an external housing, and/or to another suitable tool structure. These types of restraints 88 can be incorporated into any of the embodiments described above, and FIG. 11 serves as a representation of the potential use of restraints 88 at circumferential ends 52 of the various embodiments.

The specific configuration of tool 30 may vary depending on the parameters of a given application. Additionally, the spring member and other components of the tool may be formed from a variety of materials, including corrosion resistant materials, e.g. stainless steels, other metal alloys, nonmetal materials, composite materials and other materials suitable for a given application and environment. Also, the fastening systems, seal systems, piston assemblies, and other components of the tool, e.g. subsurface safety valve, may vary depending on the specific application and/or environment. The orientation of the overall well system and of the individual components within tool 30 also may change depending on the requirements of a specific operation.

Furthermore, several types of actuators may be used to actuate a given tool. Similarly, several types of spring members may be selected for use in providing the desired counterforce. For example, various types of arc springs may be employed to provide an annular type spring member while reserving annular space for additional components, such as a hydraulic piston. However, the annular space may be used for other types of components and devices depending on the specific application and environment for which tool 30 is designed.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system to control fluid flow in a wellbore application, comprising:

a valve having a housing with a main flow passage and a piston passage located in a housing wall between the main flow passage and an exterior surface of the housing, the valve further comprising:

a piston slidably positioned within the piston passage;

a flow tube coupled to the piston;

a valve element positioned for interaction with the flow tube to enable movement of the valve element from a closed position to an open position with respect to flow through the main passage; and a spring member positioned to bias the flow tube to a position allowing movement of the valve element to the closed position, the spring member being an arc spring surrounding a portion of the flow tube along a circumference of the flow tube to create an open annular region along the flow tube between circumferential ends of the spring member, the piston being located at least partially in the open annular region.

2. The system as recited in claim 1, wherein the valve element comprises a flapper.

3. The system as recited in claim 1, wherein the valve comprises a subsurface safety valve.

4. The system as recited in claim 1, wherein the valve comprises a hydraulic communication sleeve.

5. The system as recited in claim 1, wherein the spring member extends along more than half the circumference of the flow tube.

6. The system as recited in claim 1, wherein the spring member extends along less than half the circumference of the flow tube.

7. The system as recited in claim 1, wherein the spring member comprises a modified machined spring.

8. The system as recited in claim 1, wherein the spring member comprises a modified wave spring.

9. The system as recited in claim 1, wherein the spring member comprises a modified set of Belleville washers.

10. The system as recited in claim 1, wherein the spring member comprises an arc coil spring.

* * * * *